US012796777B1

(12) United States Patent
Øllgaard

(10) Patent No.: US 12,796,777 B1
(45) Date of Patent: Nov. 17, 2026

(54) ORTHOTIC INSERT FOR ALLEVIATING HEEL PAIN

(71) Applicant: Per Øllgaard, Viborg (DK)

(72) Inventor: Per Øllgaard, Viborg (DK)

( * ) Notice: Subject to any disclaimer, the term of this patent is extended or adjusted under 35 U.S.C. 154(b) by 0 days.

(21) Appl. No.: 19/264,773

(22) Filed: Jul. 9, 2025

(51) Int. Cl.
*A43B 7/14* (2022.01)
*A43B 17/00* (2006.01)
*A43B 17/02* (2006.01)

(52) U.S. Cl.
CPC ..... *A43B 17/023* (2013.01); *A43B 7/14* (2013.01); *A43B 17/003* (2013.01)

(58) Field of Classification Search
CPC ..... A43B 17/023; A43B 17/02; A43B 17/00; A43B 7/14; A43B 7/1405; A43B 7/142; A43B 7/1145
USPC ..... 36/43, 44
See application file for complete search history.

(56) References Cited

U.S. PATENT DOCUMENTS 2,238,366 A * 4/1941 Leydecker ..... A43B 7/14 36/180
2,468,264 A * 4/1949 Katz ..... A43B 7/1415 36/147
2,828,555 A * 4/1958 Ledos ..... A43B 7/14 36/176
5,388,351 A * 2/1995 Mitchell ..... A61F 5/14 36/145
2010/0180467 A1* 7/2010 Singleton ..... A43B 21/00 36/43
2016/0015121 A1* 1/2016 Romo ..... A43B 17/006 36/43
2016/0044990 A1* 2/2016 Georgeson ..... A43B 7/1445 36/43
2016/0095382 A1* 4/2016 Takahashi ..... A43B 17/00 36/43
2017/0079371 A1* 3/2017 Clough ..... A43B 7/149
2017/0143074 A1* 5/2017 Southern ..... A43B 7/141
2019/0069628 A1* 3/2019 Cutler ..... A43B 7/1464
2021/0267302 A1* 9/2021 Oki ..... A43B 17/00
2021/0298412 A1* 9/2021 Takahashi ..... A43B 7/143
2022/0095739 A1* 3/2022 Brackenbury ..... A43B 7/142

FOREIGN PATENT DOCUMENTS

EP 3512470 B1 1/2023
WO WO-2018050241 A1 * 3/2018 ..... A61F 5/14

* cited by examiner

*Primary Examiner* — Marie D Bays
(74) *Attorney, Agent, or Firm* — Thomas LaGrandeur

(57) ABSTRACT

An insole for alleviating heel pain, the insole including a shell plate having a length corresponding to a user's foot length; a wedge attached to the top surface of the shell plate and positioned to extend from a back wedge position located toward a rear heel portion of the shell plate to a front wedge position located towards a front toe position of the shell plate; and top fabric layer that covers the shell plate and wedge. The wedge has a rear face portion that curves upward from the back wedge position to a maximum wedge height, and a front face portion with a length that extends downward from the maximum wedge height to the front wedge position. An effective orthotic insole includes a number of ratios derived by comparing various components of the orthotic insole to each other.

20 Claims, 2 Drawing Sheets

ORTHOTIC INSERT FOR ALLEVIATING HEEL PAIN

FIELD OF THE DISCLOSURE

This disclosure relates generally to an insole that alleviates heel pain.

BACKGROUND

Heel pain commonly occurs in the feet of adults, particularly as people age. Heel pain can be located at different areas on a person's heel, including at the front, side, and back of the heel, as well as underneath the heel, which is referred to as plantar heel pain. It has been estimated that up to 10% of adults over age 50 will suffer from plantar heel pain. There are many causes of plantar heel pain, such as a new and unfamiliar activity that places a strain on a person's body, too tight or rigid shoes, standing on a ladder for an extended period of time, a day spent walking on sand, extended hiking, and so forth. There can be many different reasons why a person suffers from plantar heel pain, with some of the most common causes including Plantar Fasciitis (sometimes referred to as heel spurs), heel pad syndrome, calcaneal fracture, stress fracture, calcaneal neuroma and bone bruise.

There are many approaches toward relieving plantar heel pain, such as K-taping, shock wave therapy, exercises, laser therapy, heel cups, pain medication, or cortisone injections. These approaches typically only provide a short-term effect and then require consistent use or repetitive treatment to maintain optimal relief.

Another approach toward relieving plantar heel pain is the use of orthotic insoles that work on correcting body posture and giving arch support. While such insoles can provide pain relief, they can be a rather complex approach that does not provide efficient relief of pain underneath the heel.

Accordingly, there exists a need in the art for a straightforward, efficient approach for relieving plantar heel pain underneath the foot. The presently disclosed orthotic insert addresses this need.

SUMMARY

The disclosure presented herein relates to an orthotic insert or insole that alleviates plantar heel pain. Embodiments of the orthotic insole include a shell plate that has a length corresponding to a user's foot length. A wedge attached to the top surface of the shell plate extends from a back wedge position located toward a rear heel portion of the shell plate to a front wedge position located towards a front toe portion of the shell plate. The wedge has a rear face portion composed of a length that curves upward from the back wedge position on the shell plate to a maximum wedge height. Likewise, the wedge has front face portion having a length that declines downward from the maximum wedge height to the front wedge position on the shell plate. Furthermore, the orthotic insole includes a top fabric layer that covers the length of the insole. The top fabric layer therefore covers the wedge attached to the shell plate along with the front and rear portions of the shell plate that are not covered by the wedge.

An effective orthotic insole as described herein includes a number of ratios derived by comparing various components of the orthotic insole to each other. In one embodiment, an effective orthotic insole includes a ratio of 2.4 to 2.9 determined by comparison of the length of the rear face portion of the wedge to the maximum wedge height.

The wedge of the orthotic insole includes an interior rear angle formed at a point of intersection between the rear face portion of the wedge and the rear heel portion of the shell plate. In a preferred embodiment, the degrees of the interior rear angle of the wedge compared to the maximum wedge height has a ratio of 1.6 to 2.1. In another preferred embodiment, the degrees of the interior rear angle of the wedge compared to the maximum wedge height has a ratio of 3.1 to 3.6.

In another aspect, the wedge of the orthotic insole includes a curve radius of the rear face portion of the wedge. In a preferred embodiment, the curve radius of the wedge compared to the maximum wedge height has a ratio of 2.4 to 2.9. In another preferred embodiment, the curve radius of the wedge compared to the maximum wedge height has a ratio of 3.8 to 4.3.

In a preferred embodiment of the orthotic insole, the length of the front face portion of the wedge compared to the maximum wedge height has a ratio of 5.1 to 5.6. In another preferred embodiment of the orthotic insole, the length of the front face portion of the wedge compared to the maximum wedge height has a ratio of 6.5 to 7.0.

An orthotic insole as described herein includes a preferred embodiment in which the curve radius of the rear face portion of the wedge compared to the length of the rear face portion of the wedge has a ratio of 1.6 to 2.0. In another preferred embodiment, the curve radius of the rear face of the of the wedge compared to the length of the rear face portion of the wedge has a ratio of 2.2 to 2.7.

The wedge of the orthotic insole preferably is constructed of two layers of material that include a first lower layer covered by a second upper layer. In a preferred embodiment, the first lower layer is made of a compressible material having a Shore-A hardness measured according to ASTM D2240-97 within the range of 25 to 30 Shore-A, and the second upper layer is made of a compressible material having a Shore-A hardness measured according to ASTM D2240-97 within the range of 20 to 22 Shore-A.

The preceding and following embodiments and descriptions are for illustrative purposes only and are not intended to limit the scope of this disclosure. Other aspects and advantages of this disclosure will become apparent from the following detailed description.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

Figure 1:
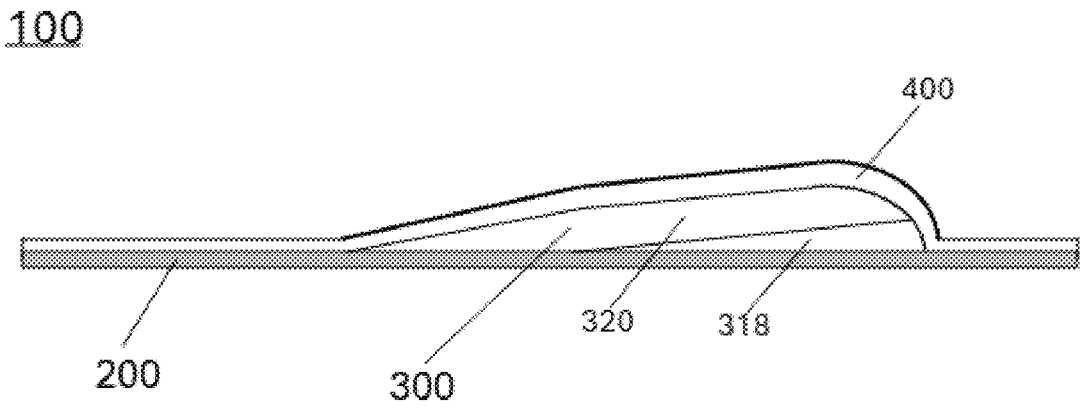
FIG. 1 shows an orthotic insert in accordance with various embodiments as described herein.

In the Summary above and in this Detailed Description, as well as the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The present description provides an orthotic insole that alleviates plantar heel pain. In general, orthotic inserts are placed into footwear such as a shoe, boot, etc. to provide additional support for the user's foot, particularly in circumstances where the wearer requires a degree of bio-mechanical support and control. An orthotic insole as described herein primarily functions to relieve or eliminate pain in a person's heel as his or her foot strikes the ground during walking, running, or other situations where off-loading of the heel can be beneficial. In particular, the orthotic insole relieves plantar heel pain associated with common causes that include, but are not limited to, Plantar Fasciitis, heel pad syndrome, calcaneal stress fracture, calcaneal nerve entrapment, bone bruise, Sever's Disease, bone tumor, osteomyelitis, Paget's disease, a pinched nerve, arthritis, etc.

The presently described orthotic insole relieves plantar heel pain by transferring impact from the back part of the heel to the region of the foot in front of it. This impact transfer is achieved by placement of a wedge on a shell plate to obtain an orthotic insert that elevates the front part of a user's heel and reduces impact to the heel pad. Accordingly, the wedge raises the distal part of the calcaneus in the user's foot to an extent that the proximal part of the user's heel only slightly touches the orthotic insert as his or her foot strikes the ground during walking or running. In this manner, the impact loads imparted to the heel are mainly transmitted to the distal part of the calcaneus.

The orthotic insole includes a general construction of a wedge that is attached to the top surface of a shell plate, along with a top fabric layer that covers the shell plate and wedge. Preferably, the shell plate is formed to the contour of the sole portion of the user's foot and is shaped to entirely cover the interior bed of the user's shoe/footwear upon which the shell plate is placed. The wedge extends from a back-end position on the shell plate corresponding to a position in front of the user's medial and lateral process of tuberosity, but in close proximity thereto, and towards a position on the shell plate corresponding to a position of the user's metatarsus. It is crucial that the wedge will not interact with the user's medial and lateral process of tuberosity, since the impact loads imparted to the heel during walking or running will otherwise mainly be transmitted to the proximal part of the calcaneus, where the heel pain is present. Preferably, the wedge is formed to the contour of the sole portion of the user's foot. The top fabric layer extends across the entire insole to provide a top layer that covers the wedge portion and the front and rear portions of the shell plate that are not covered by the wedge.

Embodiments of the orthotic insole accordingly include a shell plate that has a length corresponding to a user's foot length. The wedge attached to the top surface of the shell plate extends from a back wedge position located toward a rear heel portion of the shell plate to a front wedge position located towards a front toe portion of the shell plate. The wedge has a rear face portion composed of a length that curves upward from the back wedge position on the shell plate to a maximum wedge height. Likewise, the wedge has front face portion having a length that declines downward from the maximum wedge height to the front wedge position on the shell plate. The upper surfaces of the wedge and the shell plate (that are not covered by the wedge) are covered by a top fabric layer that constitutes the entire upper surface of the orthotic insole.

An effective orthotic insole as described herein includes a number of ratios derived by comparing various components or aspects of the orthotic insole to each other, as further described herein. In one embodiment, an effective orthotic insole includes a ratio of 2.4 to 2.9 determined by comparison of the length of the rear face portion of the wedge to the maximum wedge height, as further detailed below.

The wedge of the orthotic insole includes an interior rear angle formed at a point of intersection between the rear face portion of the wedge and the rear heel portion of the shell plate. In a preferred embodiment, the degrees of the interior rear angle of the wedge compared to the maximum wedge height has a ratio of 1.6 to 2.1. In another preferred embodiment, the degrees of the exterior rear angle of the wedge compared to the maximum wedge height has a ratio of 3.1 to 3.6.

In another aspect, the wedge of the orthotic insole includes a curve radius of the rear face portion of the wedge. In a preferred embodiment, the curve radius of the wedge compared to the maximum wedge height has a ratio of 2.4 to 2.9. In another preferred embodiment, the curve radius of the wedge compared to the maximum wedge height has a ratio of 3.8 to 4.3.

In a preferred embodiment of the orthotic insole, the length of the front face portion of the wedge compared to the maximum wedge height has a ratio of 5.1 to 5.6. In another preferred embodiment of the orthotic insole, the length of the front face portion of the wedge compared to the maximum wedge height has a ratio of 6.5 to 7.0.

An orthotic insole as described herein includes a preferred embodiment in which the curve radius of the rear face portion of the wedge compared to the length of the rear face portion of the wedge has a ratio of 1.6 to 2.0. In another preferred embodiment, the curve radius of the rear face of the of the wedge compared to the length of the rear face portion of the wedge has a ratio of 2.2 to 2.7.

The wedge of the orthotic insole preferably is constructed of two layers of material that include a first lower layer covered by a second upper layer, as further detailed below. In a preferred embodiment, the first lower layer is made of a compressible material having a Shore-A hardness measured according to ASTM D2240-97 within the range of 25 to 30, and the second upper layer is made of a compressible material having a Shore-A hardness measured according to ASTM D2240-97 within the range of 20 to 22. Accordingly, the lower layer of the wedge is firmer and has a greater density than the softer, upper layer of the wedge.

The wedge has a front face portion and a rear face portion, facing the user's foot. The rear face portion inclines upward from the shell plate with a convex curved shape. The convex curve is present for better alignment with the contour of the sole portion of the user's foot. The front face portion declines downward from the front part of the rear face portion towards the shell plate with a shape that resembles a ramp. In one or more embodiments, a part of the front face portion bordering to the rear face portion is horizontal or nearly horizontal.

The front face portion of the wedge is positioned such that a part of the user's foot corresponding to the calcaneal tubercle is resting thereon. Accordingly, the wedge material below the front face portion will direct/transmit the impact loads to the heel during exercise to the distal part of the calcaneus.

The base of the rear face portion of the wedge, where the wedge intersects with the shell plate, is typically located 40-65 mm from the rear end of the shell plate. The orthotic insole will therefore have a flat, rear heel portion that is 40-65 mm long. The exact length of the flat, rear heel portion is adjusted to fit an individual user's heel length in the user's foot. Individual lengths of the flat, rear heel portion may therefore be 40 mm; 50 mm; 55 mm; 60 mm; or 65 mm; and any incremental length between these lengths, such as 41 mm, 42 mm, 43 mm, and so on.

The rear face portion of the wedge has a curved shape that rises from the flat, rear heel portion of the shell plate. The rear face portion of the wedge preferably will rise to maximum wedge height that varies from 13 mm to 15 mm high. The maximum wedge height will correspond with an optimal height for the size of a user's foot. For example, a smaller foot size may require a wedge height of 13 mm, while a larger foot size may require a wedge height of 15 mm.

The curved shape of the rear face portion of the wedge will have a particular length from the flat, rear heel portion of the shell plate to the maximum height of the wedge. Preferred embodiments of the orthotic insole described herein will have a ratio determined by comparison of the length of the rear face portion of the wedge to the maximum height of the wedge in which the ratio ranges from 2.4 to 2.9. Accordingly, the length of the rear face portion of the wedge includes lengths of approximately 31 to 38 mm for a 13 mm maximum height wedge; 34 to 41 mm for a 14 mm maximum height wedge; and 36 to 44 mm for a 15 mm maximum height wedge. For example, a wedge with a length of curved rear face portion of 36 mm and a maximum wedge height of 15 mm will have a ratio of 2.4 (36 mm/15 mm). Likewise, a wedge with a length of curved rear face portion of 37.7 mm and a maximum wedge height of 13 mm will have a ratio of 2.9 (37/7 mm/13 mm).

The wedge of the orthotic insole includes a rear angle formed at a point of intersection between the interior of the rear face portion of the wedge and the rear heel portion of the shell plate. In preferred embodiments, the orthotic insole described herein will have a ratio determined by comparison of the degrees of the wedge rear angle to the maximum height of the wedge in which the ratio ranges from 1.7 to 2.2. Accordingly, preferred embodiments of the orthotic insole described herein will have wedge rear angles that vary from approximately 22 degrees to 29 degrees for a 13 mm maximum height wedge; approximately 24 degrees to 31 degrees for a 14 mm maximum height wedge; and approximately 26 degrees to 33 degrees for a 15 mm maximum height wedge. For example, a wedge with a wedge rear angle of 28.6 degrees and a maximum wedge height of 13 mm will have a ratio of 2.2 (28.6 degrees/13 mm). Likewise, a wedge with a wedge rear angle of 25.5 degrees and a maximum wedge height of 15 mm will have a ratio of 1.7 (25.5 degrees/15 mm).

In alternative preferred embodiments, the orthotic insole described herein will have a ratio determined by comparison of the degrees of the wedge rear angle to the maximum height of the wedge in which the ratio ranges from 3.1 to 3.6. Accordingly, preferred embodiments of the orthotic insole described herein will have wedge rear angles that vary from approximately 40 degrees to 47 degrees for a 13 mm maximum height wedge; approximately 43 degrees to 50 degrees for a 14 mm maximum height wedge; and approximately 47 degrees to 54 degrees for a 15 mm maximum height wedge. For example, a wedge with a wedge rear angle of 46.8 degrees and a maximum wedge height of 13 mm will have a ratio of 3.6 (46.8 degrees/13 mm). Likewise, a wedge with a wedge rear angle of 46.5 degrees and a maximum wedge height of 15 mm will have a ratio of 3.1 (46.5 degrees/15 mm).

As described above, the rear face portion of the wedge has a curved shape. In preferred embodiments, the orthotic insole described herein will have a ratio determined by comparison of the length of the curve radius at the top of the curve to the maximum height of the wedge in which the ratio ranges from 2.4 to 2.9. Accordingly, the length of the curve radius at the top of the curve (as measured from the interior of the wedge that rests on the shell plate) will vary from approximately 31 to 38 mm for a 13 mm maximum height wedge; 34 to 41 mm for a 14 mm maximum height wedge; and 36 to 44 mm for a 15 mm maximum height wedge. For example, a wedge with a curve radius at the top of 36 mm and a maximum wedge height of 15 mm will have a ratio of 2.4 (36 mm/15 mm). Likewise, a wedge with a curve radius at the top of 37.7 mm and a maximum wedge height of 13 mm will have a ratio of 2.9 (37/7 mm/13 mm).

In alternative preferred embodiments, the orthotic insole described herein will have a ratio determined by comparison of the length the curve radius at the top of the curve to the maximum height of the wedge in which the ratio ranges from 3.8 to 4.3. Accordingly, the length of the curve radius at the top of the curve (as measured from the interior of the wedge that rests on the shell plate) will vary from approximately 49 to 56 mm for a 13 mm maximum height wedge; 53 to 60 mm for a 14 mm maximum height wedge; and 57 to 65 mm for a 15 mm maximum height wedge. For example, a wedge with a curve radius at the top of 55.9 mm and a maximum wedge height of 13 mm will have a ratio of 4.3 (55.9 mm/13 mm). Likewise, a wedge with a curve radius at the top of 57 mm and a maximum wedge height of 15 mm will have a ratio of 3.8 (57 mm/15 mm).

In preferred embodiments of the orthotic insole, the length of the front face portion of the wedge (from the maximum wedge height to the front, forward edge of the wedge) compared to the maximum wedge height has a ratio of 5.1 to 5.6. Accordingly, the length of the front face portion will vary from approximately 66 to 73 mm for a 13 mm maximum height wedge; 71 to 78 mm for a 14 mm maximum height wedge; and 77 to 84 mm for a 15 mm maximum height wedge. For example, a wedge with a front face length of 72.8 mm and a maximum wedge height of 13 mm will have a ratio of 5.6 (72.8 mm/13 mm). Likewise, a wedge with a front face length of 76.5 mm and a maximum wedge height of 15 mm will have a ratio of 5.1 (76.5 mm/15 mm).

In alternative preferred embodiments, the length of the front face portion of the wedge compared to the maximum wedge height has a ratio of 6.5 to 7.0. Accordingly, the length of the front face portion will vary from approximately from approximately 85 to 91 mm for a 13 mm maximum height wedge; 91 to 98 mm for a 14 mm maximum height wedge; and 98 to 105 mm for a 15 mm maximum height wedge. For example, a wedge with a front face length of 84.5 mm and a maximum wedge height of 13 mm will have a ratio of 6.5 (84.5 mm/13 mm). Likewise, a wedge with a front face length of 105 mm and a maximum wedge height of 15 mm will have a ratio of 7.0 (105 mm/15 mm).

As described above, the rear face portion of the wedge of the orthotic insole includes a curve radius at the top of the curve of the wedge and a length of the rear face of the wedge (from the base of the wedge to the maximum wedge height). In preferred embodiments, an orthotic insole as described herein has a ratio defined by the length of the curve radius compared to the length of the rear face portion in which the ratio ranges from 1.6 to 2.0. For example, a wedge with a curve radius of 52.8 mm and a rear face portion length of 33 mm will have a ratio of 1.6 (52.8 mm/33 mm). Likewise, a wedge with curve radius of 64 mm and a rear face portion length of 32 mm will have a ratio of 2.0 (64 mm/32 mm).

In other preferred embodiments of the orthotic insert, the length of the front face of the wedge compared to the length of the rear face portion of the wedge has a ratio of 2.2 to 2.7. For example, a wedge with a front face portion length of 74.8 mm and a rear face portion length of 34 mm will have a ratio of 2.2 (74.8 mm/34 mm). Likewise, a wedge with a front face portion length of 100 mm and rear face portion length of 37 mm will have a ratio of 2.7 (100 mm/37 mm).

The wedge of the orthotic insole preferably is constructed of two layers of material that include a first lower layer covered by a second upper layer, as further detailed below. In a preferred embodiment, the first lower layer is made of a compressible material having a Shore-A hardness measured according to ASTM D2240-97 within the range of 25 to 30 Shore-A, and the second upper layer is made of a compressible material having a Shore-A hardness measured according to ASTM D2240-97 within the range of 22 to 22 Shore-A. Accordingly, the first lower layer of the wedge is constructed of a firmer material that has a greater density than the softer material used to construct the second upper layer of the wedge.

As described above, the orthotic insole includes a wedge attached to a sole plate. Preferably, the shell plate is formed to the contour of the sole portion of the user's foot. The material from which the shell plate is fabricated may be one of any number of thermoplastics or thermosetting plastics. Polyethylene, polypropylenes, acrylics, polycarbonates, ABS plastics, PVC plastics, polyesters, epoxy resins, and various laminated plastics may be used. A preferred composition for the shell plate is a thermoplastic co-polymer of polypropylene with about 15% polyethylene added. Another preferred composition for the shell plate is ethylene vinyl acetate (EVA) that has a closed cell structure.

The wedge layers can be constructed of any of several appropriate materials. Such materials for the wedge can include, but are not limited to, thermoplastic elastomers, polyester, polypropylene, polyethylene, polyurethane (PU), polyurea, cellular urethane, polystyrene, latex, nylon, carbon or glass fibers with thermosetting or thermoplastic resins, plastizote, ethylene vinyl acetate (EVA) foams, expanded vinyl foam, flocked vinyl film, coagulated polyurethane, supported polyurethane foam, poly-urethane film, latex foam on scrim, styrene-butadiene-rubber, acrylonitrile-butadiene, acrylonitrile terpolymers and copolymers, styrene-butadienestyrene, acrylonitrile-butadiene-styrene, polyvinyl chloride (PVC), ethylenepropylene rubber, silicone rubber (SiR), silicone elastomer, acrylic rubber (ACM), butadiene rubber (BR), butyl rubber (IIR), chlorosulfonated polyethylene (CSM)/hypalonthylene propylene diene monomer (EPM, EPDM), fluoroelastomers (FKM), isoprene rubber (IR), nitrile rubber (NBR), perfluoroelastomer (FFKM), polychloroprene (CR), polysulfide rubber (PSR), styrene butadiene rubber (SBR), or any combination thereof. In a preferred embodiment, the lower layer of the wedge is made of a combination of EVA and PU, such as Impulflex, available from AFT International. In another preferred embodiment, the upper layer of the wedge is made of EVA, such as Highflex, available from AFT International.

The wedge may be formed from a foam, a rubber, or any combination thereof. In one or more embodiments, the wedge is made of an open cell and/or closed cell foam material. Preferably the wedge is made of a closed cell foam material, since moisture may enter an open cell foam material, and thereby change its hardness (Shore A).

The orthotic insoles described herein include a top layer of fabric material that covers the wedge attached to the shell plate and the front and rear portions of the shell plate that are not covered by the wedge. The top layer of fabric therefore covers the length of the orthotic insole and constitutes its entire top surface. In a preferred embodiment, the top layer of fabric is constructed of a microfiber material. Preferably, the top layer of fabric is perforated to increase the breathability of the top layer so as to reduce moisture and sweat absorption in the insole. A preferred embodiment of the top layer of the orthotic insole is constructed from the microfiber material onSteam®, which is available from Grupo Moron.

Referring to FIG. 1, the general construction of an orthotic insole as described herein is shown. FIG. 1 shows a side view of an orthotic insole 100, which includes a shell plate 200, a wedge 300, and an upper fabric layer 400. The orthotic insole 100 shown in FIG. 1 provides a representation of the different layers of the orthotic insole 100 but is not drawn to the exact scale of each of the layers. The shell plate 200 and upper fabric layer 400 each have a length that approximately corresponds to the length of a user's foot and the length of the inner bed of the footwear (such as a shoe or boot) that the insole will be placed upon.

In a preferred embodiment, the shell plate 200 is constructed of 3-4 mm thick ethylene vinyl acetate (EVA) that has a closed cell structure. Preferably, the wedge 300 is constructed of two wedge layers: a lower wedge layer 318 and an upper wedge layer 320. The wedge layers in FIG. 1 will have different hardness properties, as the material of the lower layer 318 will have a Shore-A hardness measured according to ASTM D2240-97 within the range of 25 to 30, and the material of the second upper layer 320 will have a Shore-A hardness measured according to ASTM D2240-97 within the range of 20 to 22. In a preferred embodiment, the lower layer 318 of the wedge 300 is constructed of a combination of EVA and PU, such as Impulflex, available from AFT International, while the upper layer 320 is constructed of EVA, such as Highflex, available from AFT International. Preferably, each of the wedge layers will have an individual wedge thickness ranging from 0.1 to 13 mm, depending upon where a given wedge layer is measured (such as at its thinnest or thickest point). In a preferred embodiment, the upper fabric layer 400 is constructed of a microfiber material such as onSteam®, which is available from Grupo Moron. Preferably, the upper fabric layer 400 is perforated to increase breathability of the orthotic insole 100 and to reduce or eliminate moisture and sweat absorption in the insole 100. Preferably, the upper layer fabric will have a thickness ranging from 0.2 to 3 mm.

Figure 2:
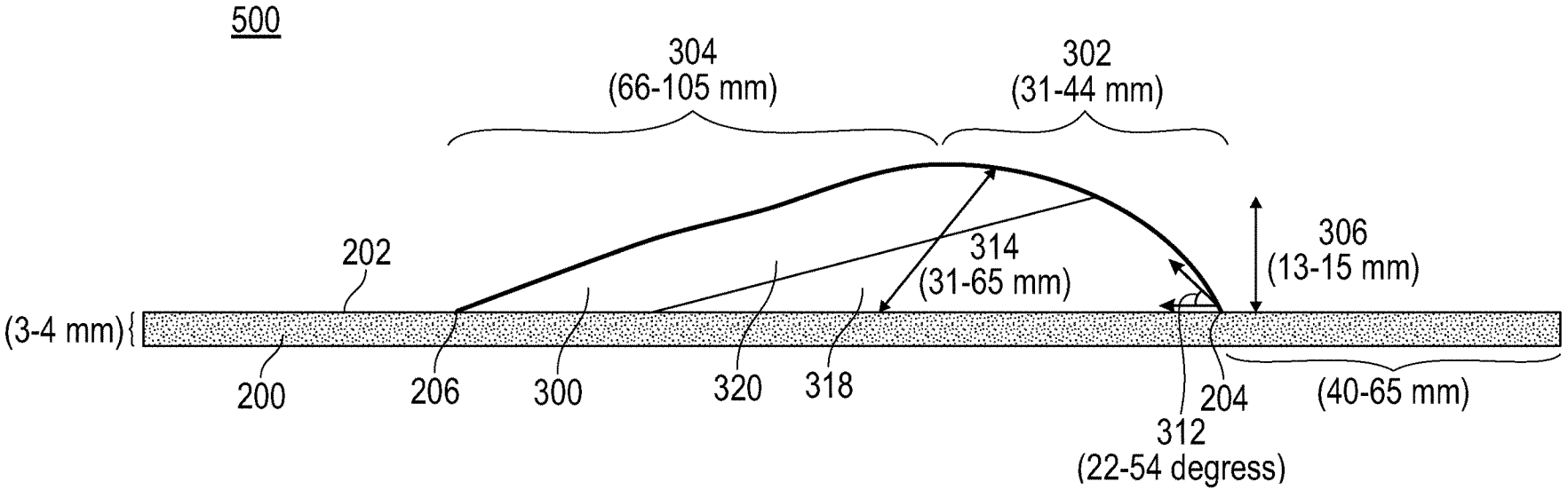
FIG. 2 shows a partial orthotic insert in accordance with various embodiments as described herein.

Referring to FIG. 2, the general construction of a partial orthotic insert is shown. FIG. 2 shows a side view of an orthotic insole 500 that includes a sole plate 200 and a wedge 300. The shell plate 200 and wedge 300 of an orthotic insole 500 is shown without the upper fabric layer of an orthotic insole (such as layer 400 in the insole 100 of FIG. 1) to provide greater detail of the shell plate and wedge configuration. The shell plate 200 has a length that approximately corresponds to the length of a user's foot and the length of the inner bed of the footwear (such as a shoe or boot) that the insole will be placed upon.

The wedge 300 is attached to the top surface 202 of the shell plate 200. The wedge 300 extends from a back-end position 204 on the shell plate 200 corresponding to a position in front of the user's medial and lateral process of tuberosity, and towards a front-end position 206 on the shell plate 200 corresponding to a position of the user's metatarsus. It is crucial that the wedge 300 will not interact with the user's medial and lateral process of tuberosity, since the impact loads imparted to the heel during exercise will otherwise mainly be transmitted to the proximal part of the calcaneus, which is an area where user's experience plantar heel pain.

The back-end position 204 of the wedge 300 on the shell plate 200 varies depending on the size of the user's foot. For most applications, the wedge 300 is situated between 40-65 mm from the rear end of the shell plate 200.

The wedge 300 has a rear face portion 302 and a front face portion 304. The rear face portion 302 curves upward from the shell plate 200 to a maximum height 306. The front face portion 304 declines downward from the maximum height 306 toward a front-end position 206 that meets a front toe portion of the shell plate 200. In a preferred embodiment, the front face portion 304 declines downward in two phases, with a first, upper phase that is flatter than the second, lower phase that meets the top of the shell plate, 202.

The rear face portion 302 has a length that is measured from the base of the wedge 300 (where the rear of the wedge 300 meets the shell plate 200 at back-end position 204) to the maximum height of the wedge 306. In preferred embodiments, the length of the rear face portion 302 compared to the maximum height has a ratio of 2.4 to 2.9. For example, an orthotic insole that has a rear face portion 302 length of 35 mm and a maximum wedge height 306 of 13 mm will have a ratio of 2.7 (35 mm/13 mm).

The point at which the rear face portion 302 of a wedge 300 meets a shell plate 200 at back-end position 204 has an interior wedge take off angle 312. In preferred embodiments of the orthotic insole, the wedge take off angle 312 compared to the maximum wedge height 306 will define a ratio of 1.7 to 2.2. For example, an orthotic insole 100 having a wedge take off angle 312 of 26 degrees and a maximum wedge height 306 of 13 mm will have a ratio of 2 (26 degrees/13 mm).

In other preferred embodiments of the orthotic insole 100, the wedge take off angle 312 compared to the maximum wedge height 306 will have a ratio of 3.1 to 3.6. An exemplary orthotic insole 100 having a wedge take off angle 312 of 48 degrees and a maximum wedge height 306 of 15 mm will have a ratio of 3.2 (48 degrees/15 mm).

The rear face portion 302 of a wedge 300 has a curve radius 314 measured from the base of the wedge to the top of the curvature of the rear face portion 302. In preferred embodiments of the orthotic insole 100, the length of the curve radius 314 compared to the maximum wedge height 306 will define a ratio between 2.4 to 2.9. Accordingly, an exemplary wedge 300 may have a curve radius of 36 mm and a wedge height of 13 mm to yield a ratio of 2.7 (35 mm/13 mm).

In other preferred embodiments, the orthotic insole 500 will contain a ratio defined by the length of the curve radius 314 compared to the maximum wedge height 306 such that the ratio is 3.8 to 4.3. For example, a wedge 300 may have a curve radius of 57 mm and a maximum wedge height of 15 mm for a ratio of 3.8 (57 mm/15 mm).

In another aspect of preferred embodiments, the orthotic insole 500 will include a ratio defined by the length of the front face portion 304 compared to the maximum wedge height 306, such that the ratio will range from 5.1 to 5.6. An exemplary wedge 300 having a front face portion 304 length of 73 mm and a maximum wedge height 306 of 13.5 mm will have a ratio of 5.4 (73 mm/13.5 mm).

In alternative preferred embodiments of the orthotic insole 500, the ratio of the length of the front face portion 304 compared to the maximum wedge height 306 will vary from 6.5 to 7.0. For example, a wedge 300 having a front face portion 304 length of 99 mm and a maximum height wedge of 15 mm will have a ratio of 6.6 (99 mm/15 mm).

In yet other preferred embodiments of the orthotic insole 500, the ratio defined by the length of the curve radius 314 compared to the length of the rear face portion 302 will lie between 1.6 to 2.0. An exemplary preferred wedge 300 having a curve radius 314 of 64 mm and a rear face portion 302 length of 32 mm will have a ratio of 2.0 (64 mm/32 mm).

In other preferred embodiments, the orthotic insole 500 will have a wedge 300 in which the ratio defined by comparison of the length of the front face portion 304 to the length of the rear face portion 302 lies between 2.2 to 2.7. For example, a wedge 300 with a front face portion 304 length of 100 mm and rear face portion 302 length of 37 mm will have a ratio of 2.7 (100 mm/37 mm).

In preferred embodiments of the orthotic insole 500, the wedge 300 will have a dual layer construction in which a first, lower layer 318 of compressible wedge material is covered by a second, upper layer 320 of compressible wedge material (see FIG. 1). In these preferred embodiments, the material of the lower layer 318 will have a Shore-A hardness measured according to ASTM D2240-97 within the range of 25 to 30, and the material of the second upper layer 320 will have a Shore-A hardness measured according to ASTM D2240-97 within the range of 20 to 22.

In a preferred embodiment, the volume of the second upper layer 320 of the wedge 300 will be approximately two to three times greater than the volume of the first lower layer 318 of the wedge 300. Accordingly, the wedge 300 is constructed of about one-third first lower layer 318 to about two-thirds second upper layer 320. In addition, the second upper layer 320 overlays the first lower layer 318 at an angle that approximates that defined by the declination of the front face portion from the maximum wedge height 306 to the front-end position 206 on the shell plate 200.

The corresponding structures, materials, acts, and equivalents of all means or steps plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The exemplary, preferred embodiment was chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

The invention claimed is:

1. An orthotic insole comprising:

a shell plate, the shell plate having a length corresponding to a user's foot length;

a wedge attached to a top surface of the shell plate, the wedge extending from a back wedge position located toward a rear heel portion of the shell plate to a front wedge position located towards a front toe portion of the shell plate;

an upper fabric layer that covers the wedge and top surface portions of the shell plate that are not covered by the wedge at the rear heel and front toe portions of the shell plate;

wherein the rear portion of the wedge has a length that curves upward from the point of interception between the rear portion of the wedge and the shell plate to a maximum wedge height;

wherein the wedge has a front face portion, a height of the wedge decreasing from the maximum wedge height toward the front wedge position on the shell plate;

wherein the length of the rear face portion of the wedge ranges from 31 to 44 mm;

wherein the maximum wedge height ranges from 13 to 15 mm; and wherein the ratio of the length of the rear face portion of the wedge to the maximum wedge height is 2.4 to 2.9.

2. The orthotic insole of claim 1, wherein the wedge has an interior rear angle formed at a point of intersection between the rear face portion of the wedge and the rear heel portion of the shell plate;

wherein the rear angle degrees range from 22 to 54 degrees;

wherein the maximum wedge height ranges from 13 to 15 mm; and wherein the ratio of the rear angle degrees to the maximum wedge height is 1.7 to 2.2.

3. The orthotic insole of claim 1, wherein the wedge has a rear angle formed at a point of intersection between the rear face portion of the wedge and the rear heel portion of the shell plate;

wherein the rear angle degrees range from 22 to 54 degrees;

wherein the maximum wedge height ranges from 13 to 15 mm; and wherein the ratio of the rear angle degrees to the maximum wedge height is 3.1 to 3.6.

4. The orthotic insole of claim 1, wherein the rear face portion of the wedge has a curve radius;

wherein the curve starts from the point of the interception between the rear portion of the wedge and the shell plate to the maximum wedge height;

wherein the curve radius ranges from 31 to 65 mm;

wherein the maximum wedge height ranges from 13 to 15 mm; and wherein the ratio of the curve radius to the maximum wedge height is 2.4 to 2.9.

5. The orthotic insole of claim 1, wherein the rear face portion of the wedge has a curve radius;

wherein the curve starts from the point of the interception between the rear portion of the wedge and the shell plate to the maximum wedge height;

wherein the curve radius ranges from 31 to 65 mm;

wherein the maximum wedge ranges from 13 to 15 mm; and wherein the ratio of the curve radius to the maximum wedge is 3.8 to 4.3.

6. The orthotic insole of claim 1, wherein the length of the front face portion of the wedge ranges from 66 to 105 mm;

wherein the maximum wedge height ranges from 13 to 15 mm; and wherein the ratio of the length of the front face portion of the wedge to the maximum wedge height is 5.1 to 5.6.

7. The orthotic insole of claim 1, wherein the length of the front face portion of the wedge ranges from 66 to 105 mm;

wherein the maximum wedge height ranges from 13 to 15 mm; and wherein the ratio of the length of the front face portion of the wedge to the maximum wedge height is 6.5 to 7.0.

8. The orthotic insole of claim 1, wherein the rear face portion of the wedge has a curve radius;

wherein the curve starts from the point of the interception between the rear portion of the wedge and the shell plate to the maximum wedge height;

wherein the curve radius ranges from 31 to 65 mm;

wherein the length of the rear face portion of the wedge ranges from 31 to 44 mm; and wherein the ratio of the curve radius to the length of the rear face portion of the wedge is 1.6 to 2.0.

9. The orthotic insole of claim 1, wherein the length of the front face portion of the wedge ranges from 66 to 105 mm;

wherein the length of the rear face portion of the wedge ranges from 31 to 44 mm; and wherein the ratio of the length of the front face portion of the wedge to the length of the rear face portion of the wedge is 2.2 to 2.7.

10. The orthotic insole of claim 1, wherein the wedge comprises a first lower layer covered by a second upper layer;

wherein the first lower layer is made of a compressible material having a Shore-A hardness measured according to ASTM D2240-97 within the range of 25 to 30; and wherein the second upper layer is made of a compressible material having a Shore-A hardness measured according to ASTM D2240-97 within the range of 20 to 22.

11. An orthotic insole comprising:

a shell plate, the shell plate having a length corresponding to a user's foot length;

a wedge attached to a top surface of the shell plate, the wedge extending from a back wedge position located toward a rear heel portion of the shell plate to a front wedge position located towards a front toe portion of the shell plate;

an upper fabric layer that continuously covers the front toe portion of the shell plate, the wedge, and the rear heel portion of the shell plate;

wherein the rear portion of the wedge has a length that curves upward from the point of interception between the rear portion of the wedge and the shell plate to a maximum wedge height;

wherein the wedge has a front face portion, a height of the wedge decreasing from the maximum wedge height toward the front wedge position on the shell plate; and wherein the length of the front face portion of the wedge ranges from 66 to 105 mm;

wherein the length of the rear face portion of the wedge ranges from 31 to 44 mm; and wherein the ratio of the length of the front face portion of the wedge to the length of the rear face portion of the wedge is 2.2 to 2.7.

12. The orthotic insole of claim 11, wherein the length of the rear face portion of the wedge ranges from 31 to 44 mm;

Wherein the maximum wedge height ranges from 13 to 15 mm; and wherein the ratio of the length of the rear face portion of the wedge to the maximum wedge height is 2.4 to 2.9.

13. The orthotic insole of claim 11, wherein the wedge has an interior rear angle formed at a point of intersection between the rear face portion of the wedge and the rear heel portion of the shell plate;

wherein the rear angle degrees ranges from 22 to 54 degrees;

wherein the maximum wedge height ranges from 13 to 15 mm; and wherein the ratio of the rear angle degrees to the maximum wedge height is 1.7 to 2.2.

14. The orthotic insole of claim 11, wherein the wedge has a rear angle formed at a point of intersection between the rear face portion of the wedge and the rear heel portion of the shell plate;

wherein the rear angle degrees ranges from 22 to 54 degrees;

wherein the maximum wedge height ranges from 13 to 15 mm; and wherein the ratio of the rear angle degrees to the maximum wedge height is 3.1 to 3.6.

15. The orthotic insole of claim 11, wherein the rear face portion of the wedge has a curve radius;

wherein the curve starts from the point of the interception between the rear portion of the wedge and the shell plate to the maximum wedge height;

wherein the curve radius ranges from 31 to 65 mm;

wherein the maximum wedge height ranges from 13 to 15 mm; and wherein the ratio of the curve radius to the maximum wedge height is 2.4 to 2.9.

16. The orthotic insole of claim 11, wherein the rear face portion of the wedge has a curve radius;

wherein the curve starts from the point of the interception between the rear portion of the wedge and the shell plate to the maximum wedge height;

wherein the curve radius ranges from 31 to 65 mm;

wherein the maximum wedge height ranges from 13 to 15 mm; and wherein the ratio of the curve radius to the maximum wedge height is 3.8 to 4.3.

17. The orthotic insole of claim 11, wherein the length of the front face portion of the wedge ranges from 66 to 105 mm;

wherein the maximum wedge height ranges from 13 to 15 mm; and wherein the ratio of the length of the front face portion of the wedge to the maximum wedge height is 5.1 to 5.6.

18. The orthotic insole of claim 1, wherein the length of the front face portion of the wedge ranges from 66 to 105 mm;

wherein the maximum wedge height ranges from 13 to 15 mm; and wherein the ratio of the length of the front face portion of the wedge to the maximum wedge height is 6.5 to 7.0.

19. The orthotic insole of claim 1, wherein the rear face portion of the wedge has a curve radius;

wherein the curve starts from the point of the interception between the rear portion of the wedge and the shell plate to the maximum wedge height;

wherein the curve radius ranges from 31 to 65 mm;

wherein the length of the rear face portion of the wedge ranges from 31 to 44 mm; and wherein the ratio of the curve radius to the length of the rear face portion of the wedge is 1.6 to 2.0.

20. The orthotic insole of claim 11, wherein the wedge comprises a first lower layer covered by a second upper layer;

wherein the first lower layer is made of a compressible material having a Shore-A hardness measured according to ASTM D2240-97 within the range of 25 to 30; and wherein the second upper layer is made of a compressible material having a Shore-A hardness measured according to ASTM D2240-97 within the range of 20 to 22.

* * * * *